US007522978B2

(12) United States Patent
Minkowitz et al.

(10) Patent No.: US 7,522,978 B2
(45) Date of Patent: Apr. 21, 2009

(54) METHOD AND DEVICE OF GENERATING LOGIC CONTROL UNITS FOR RAILROAD STATION-BASED VITAL COMPUTER APPARATUSES

(75) Inventors: Cydney Minkowitz, Sale (GB); Francesco Tramontana, Fossombrone (IT)

(73) Assignee: Alstom Ferroviaria S.p.A., Savigliano (IT)

( * ) Notice: Subject to any disclaimer, the term of this patent is extended or adjusted under 35 U.S.C. 154(b) by 656 days.

(21) Appl. No.: 10/505,366

(22) PCT Filed: Feb. 18, 2003

(86) PCT No.: PCT/EP03/01595

§ 371 (c)(1),
(2), (4) Date: Sep. 10, 2004

(87) PCT Pub. No.: WO03/070537

PCT Pub. Date: Aug. 28, 2003

(65) Prior Publication Data

US 2005/0107890 A1 May 19, 2005

(30) Foreign Application Priority Data

Feb. 22, 2002 (IT) ..... SV02A0009

(51) Int. Cl.
*G06F 9/00* (2006.01)

(52) U.S. Cl. ..... 701/19; 246/3

(58) Field of Classification Search ..... 701/19, 701/20; 246/1 R, 3, 5, 167 R; 340/500, 540, 340/825

See application file for complete search history.

(56) References Cited

U.S. PATENT DOCUMENTS

| | | | | | |
|---|---|---|---|---|---|
| 3,691,370 | A | * | 9/1972 | Pal et al. | 246/125 |
| 3,976,272 | A | * | 8/1976 | Murray et al. | 246/5 |
| 4,926,343 | A | * | 5/1990 | Tsuruta et al. | 706/45 |
| 5,050,823 | A | * | 9/1991 | Parker | 246/5 |
| 5,053,964 | A | * | 10/1991 | Mister et al. | 701/19 |
| 5,463,552 | A | * | 10/1995 | Wilson et al. | 701/117 |
| 5,751,569 | A | * | 5/1998 | Metel et al. | 700/3 |
| 6,286,130 | B1 | | 9/2001 | Shah et al. | |

FOREIGN PATENT DOCUMENTS

EP 1085415 3/2001

* cited by examiner

*Primary Examiner*—Dalena Tran
(74) *Attorney, Agent, or Firm*—James Creighton Wray

(57) ABSTRACT

A method of generating logic control units for railroad station-based vital computer apparatuses, i.e. in railroad station system control units comprising at least one vital computer which, on the basis of a control program operating in combination with a logic unit, sends state switching controls to yard elements and receives state feedback and/or diagnostic signals from the yard elements. The logic unit is generated automatically by a program, based on the surrounding conditions as defined by the station diagram and by a state table, the logic unit being a network of circuits with components operating according to Boolean logic functions and appropriate structure in compliance with the station diagram and with the state table. The logic control unit may be a program which includes algorithms composed of Boolean logic functions, which operate like networks of Boolean logic circuits. A plurality of steps to check for structural differences.

14 Claims, 2 Drawing Sheets

METHOD AND DEVICE OF GENERATING LOGIC CONTROL UNITS FOR RAILROAD STATION-BASED VITAL COMPUTER APPARATUSES

This application claims the benefit of Italian Application No. SV2002A000009 filed Feb. 22, 2002 and PCT/EP03/01595 filed Feb. 18, 2003.

BACKGROUND OF THE INVENTION

The invention addresses a method of generating logic control units for railroad Station-based Vital Computer Apparatuses, i.e. in railroad station system control units comprising at least one vital computer which, on the basis of a control program operating in combination with a logic unit, sends state switching controls to so-called yard elements, i.e. devices that are designed to perform specific train circulation-related operations, such as signaling devices and/or railroad switches and/or track circuits, or the like, and receives state feedback and/or diagnostic signals from said yard elements, said logic unit being generated automatically by a program, on the basis of the surrounding conditions as defined by the station diagram, comprising the list of yard elements and the location thereof with respect to tracks, and by a state table, wherein state assuming and/or state switching rules are settled for said yard elements, with reference to state and/or to state switching of the other yard elements and/or to the proper management of railroad traffic, said logic unit being a network of circuits with components operating according to Boolean logic functions and appropriately structured in compliance with the station diagram and with the state table, or said logic control unit being a program which includes algorithms composed of Boolean logic functions, which operate like networks of Boolean logic circuits.

A method and a system of this type is known from the Italian Patent application ITGE94A000061.

Station systems generally include a central unit which generates controls for different yard elements, such as signals and/or switches and/or track circuits, or the like. In order to ensure that train can transit safely, these yard elements shall assume different states, such as a "track open" or a stop signal, or the switching of a railroad switch according to a certain logic, which accounts for the states or state switching of other yard elements which, when brought to or left in certain states, might cause collisions or dangerous situations, or even simply not meet the regulations of admitted train circulation operations.

Yard elements are generally provided with actuators which perform state switching operations and with control and/or monitoring and/or diagnostic devices which send signals about the current state and the functionality thereof, so that the station-based stationary apparatus, i.e. the central control unit may have all railroad traffic settings under control at all time. Therefore, a predetermined state switching control transmitted to a particular element generates a chain of state maintaining or switching controls to other yard elements according to well-defined rules. Hence, the central control unit not only has control output subunits to communicate with each of the different elements in a dedicated manner, both for sending controls and for receiving feedback, but shall also operate under a strict logic, which incorporates yard element state switching rules, in compliance with safety assurance operations. These networks may be, and actually have been, purely made of hardware, i.e. of networks of circuits connected to a plurality of hardware components designed to perform predetermined Boolean operations. Typically, in railroad applications, the components designed to perform Boolean operations consisted of relay connection circuits or logic integrated circuits specially designed and connected to generate controls outputs compatible with yard element state switching rules.

As computers were introduced in railroad applications, hardware logic units were progressively replaced by control and monitoring programs including sets of Boolean equations, which describe the behaviors of the individual hardware Boolean operators and form, when appropriately integrated in a logic control program, a hardware-equivalent virtual logic unit.

A central vital computer may include different standardized library procedures, e.g. drivers for generating state switching controls, programs for managing diagnostic, control and monitoring functions which incorporate control and monitoring structures and reproduce general safety regulated movement rules. However, these general management programs need to be specially customized based on the particular structure of the station system, i.e. of its yard elements, and on related state switching rules, the so-called state tables. To this end, each central unit needs a logic control program for relating control and monitoring operations to the surrounding conditions, as defined by the station system structure. These control logics cannot be prefabricated but are application-dependent, i.e. depend on the specific station system construction.

Control logics, composed of sets of Boolean equations, whose variables are given by the states of the different elements and by the state controls and diagnostic data thereof, are known to be generated by automatic systems, i.e. generation programs which generate the sets of Boolean equations that form the algorithms of station-specific control and monitoring logic programs by using state tables or state switching tables and the station system diagram as a knowledge or input base.

In prior art, the method provides the implementation of the control logic so obtained in the vital computer of the logic control and monitoring module, and a consequent functional check, by possibly editing the logic program when errors or state incompatibilities between yard elements occur. This functional check typically includes field tests, i.e. is performed when the control and monitoring unit is installed in the specific station system.

The check mode is relatively complex and time-consuming. Further, when the logic unit is not a software product, but is composed of a set of electronic components designed to perform Boolean functions, the implementation is even more difficult, because the circuit has to be constructed before checking the operation thereof.

SUMMARY OF THE INVENTION

The invention has the object of improving a method as described above to reduce time requirements simplify checking operations, while maintaining a high operational safety of the logic unit, in compliance with yard element state switching rules and with the station structure.

The invention achieves the above purposes by providing a method as described hereinbefore, which includes the following steps:

parallel generation of two logic control units, according to the same station diagram and the same state table, the two units being generated by two generation programs which are as different as possible from each other;

comparison between the networks of logic circuits or the network-simulating logic programs provided the two different generation programs to check for differences therebetween.

When no difference is found, the Boolean equations of the logic control and monitoring unit shall be deemed correct. When differences are detected, changes and corrections shall be made.

These changes and corrections may even consist in checking that the state tables and the station diagram are properly coded in a discernible format for generation programs.

The two logic generation programs are independent, and may differ both in terms of programming languages and in terms of systematic variable analysis and reading approach.

In very big station systems, a great number of variables is provided and, although the algorithm is only meant to perform simple operations, the number of yard elements and the logic connections between states may require a hard processing task. Here, processing algorithms may be used that consist of so-called neural networks, whereto lists of yard elements and state tables governing state or state switching relations between yard elements are provided as a knowledge base. Neural network provide the considerable advantage that they extend their knowledge use after use, since the knowledge base and the interpretation thereof progressively increases, and the computing modes are changed as a result thereof. Moreover, neural networks use the knowledge base substantially regardless of the specific structure of the state table and the station diagram, and are generally able to recognize identical or similar situations and to use them as an experience to handle new situations having analogies with knowledge base situations.

The logic control units generated by the two generation programs consist, when provided in software form, of a set of equations whose generation was based on the state table and on station element related information.

Station element related information include the type of inputs and outputs required by station elements, an ID code and a control program, i.e. a driver for turning the control generated by the logic unit into a discernible control for the yard element and time tags.

It shall be noted that, like in prior art, the control logic is independent from the specific driver type, and that it only needs to know control input and/or control output variables.

This allows the method to be also used on existing control units when the station is to be extended. In this case, a new control logic is generated to account for variations, and no driver or other components must be provided other than those existing in the memories of the central control unit, in specially dedicated sections, which are appropriately recalled or routed by the logic control unit, when the relevant element is to be handled.

In this case, the generation programs, as well as the state table and station diagram input or reading modules may form a stable section in the managing software of the central control unit, i.e. the Vital Computer Stationary Apparatus.

As a program for comparing the resulting logic units, i.e. the equations of algorithms that define logic units, comparison software products may be used, e.g. MKS Visual Difference for Win 32—Release 3.2b by Mortice Kern Systems Inc. and/or Microsoft® WinDiff—Release 4.0 by Microsoft Corp.

If a coincident result is obtained from the comparison between the logic control units generated by the two different generation programs, i.e. if no difference is detected, the generated logic control unit is deemed to be correct.

If the two units do not coincide, the comparing program provides a list of differences that shall be analyzed to make corrections, whereupon the steps of generating the logic control unit by the two different generation programs and of comparing them, shall be repeated.

The advantage of this check mode is considerable, since it can be performed without requiring the control logic to be actually implemented in the system, checking operations being performed directly and only on the virtual data of the computer used for generating the logic control unit. The generated logic control unit is not even required to be loaded in the central control unit, nor is it necessary to interface it with the control programs and the drivers contained therein.

In accordance with another characteristic, the control logic generation programs receive an input which not only includes yard element state-related variable data, but also monitoring signal state-related variable data, which are provided by yard elements as an output to the central control unit.

Besides monitoring variable-related data, the generation programs of the control logic also receives yard element diagnostic variable-related data.

According to an additional improvement, the comparison program and/or the second generation program and/or both generation programs include routines for displaying the encountered errors, which are provided as error messages.

Here again, correction routines may be provided, to be initiated by the user at will or skipped, if the user decides to make organic and structured corrections at the end of the generating and/or comparing procedure.

In accordance with yet another improvement, since the two control logic generating programs must be at least slightly different, at least one of the two generation programs may include a starting routine for analyzing input data, i.e. the state table and/or the state switching table and/or the list of yard elements in the specific station system diagram.

Here, the above input data are checked for structural consistency both as regards coding or structure thereof, and as regards the presence of errors or logical contradictions, such as keys identifying non unique yard elements, prohibited or impossible combinations of yard elements which are required by the station system, etc. Therefore, in this preliminary phase, perfect consistency is ensured for the input database that forms the knowledge base of logic control unit generating programs.

It shall be noted that the inventive method allows very easy integrations in station systems wherein yard elements have to be added in fact, since prefabricated driver units are provided for each yard element, new yard elements may be simply added by updating the station system diagram, i.e. the list of elements and the state tables, and by generating in parallel two logic control units, as well as by comparing them to update the central control unit to the new station system situation.

The logic control unit generating programs are substantially unrelated from yard element types, and do not require knowledge of the individual yard element drivers, nor of monitoring and diagnostic systems, but only need the indication of the number and type of the control data to be provided to the yard element and the monitoring and diagnostic data to be transmitted by the yard element or the driver units thereof. The compliance of these control and monitoring or diagnostic variables with the yard element is ensured by the specific driver which turns the control and monitoring and diagnostic variables into the structure required by the yard element hardware—as regards control variables—and into the structure required by the central control unit—as regards monitoring and diagnostic variables.

The invention also addresses an operating Railroad Vital Station Control Apparatus (so-called ASCV), which is designed to form the central control unit for a plurality of yard elements of a station system, which Railroad Station-based Vital Computer Apparatus includes inputs for monitoring and diagnostic signals generated by yard elements, outputs for yard element state switching control signals, a control program which has a driver for each different type of yard element, i.e. a program for controlling and interfacing the control variables generated by the station apparatus and transmitted to the yard elements and/or monitoring and/or general diagnostic variables generated by yard elements and transmitted to the station apparatus, a station system diagram, i.e. a knowledge base containing a list of the station system yard elements and the relations therebetween, a database of state assuming or state switching rules admitted for the different yard elements according to safe railroad traffic management requirements, the so-called state table, a logic control unit which includes algorithms consisting of Boolean equations and/or logic functions for proper control transmission and concatenation of yard element control sequences according to the station system diagram and to the state table.

In accordance with the invention, the Station-based Vital Computer Apparatus further includes a program for automated and redundant generation of the algorithms which form the logic control unit, which uses redundancy to perform a software check of said algorithms of the logic control unit.

This program forms a routine that the user can recall whenever the station system diagram is changed, i.e. when yard elements are added or removed and/or station traffic management rules, i.e. the state table, are changed.

Redundancy is generated by using two different programs for generating the Boolean algorithms that form the logic control unit, which programs provide two logic control units, whose algorithms, i.e. Boolean equations, are compared, and are deemed to be correct when no difference between the generation algorithms result from the comparison.

The correctness of logic control unit algorithms is totally ensured by providing two generation programs which are different to a certain extent, their difference level being provided by using two different programming languages for the generation programs and/or by having the two generation programs developed by two different developing teams and/or by using different structures of input data, i.e. of station system diagram and/or state table data, which are nevertheless consistent with station system diagram and state table restrictions, the latter being the same for both generation programs.

Improvements of the invention will form the subject of the dependent claims.

The advantages of the invention will appear more clearly from the following description of a non-limiting embodiment which is described on the basis of the annexed figures, in which:

DETAILED DESCRIPTION OF THE PREFERRED EMBODIMENTS

Figure 1:
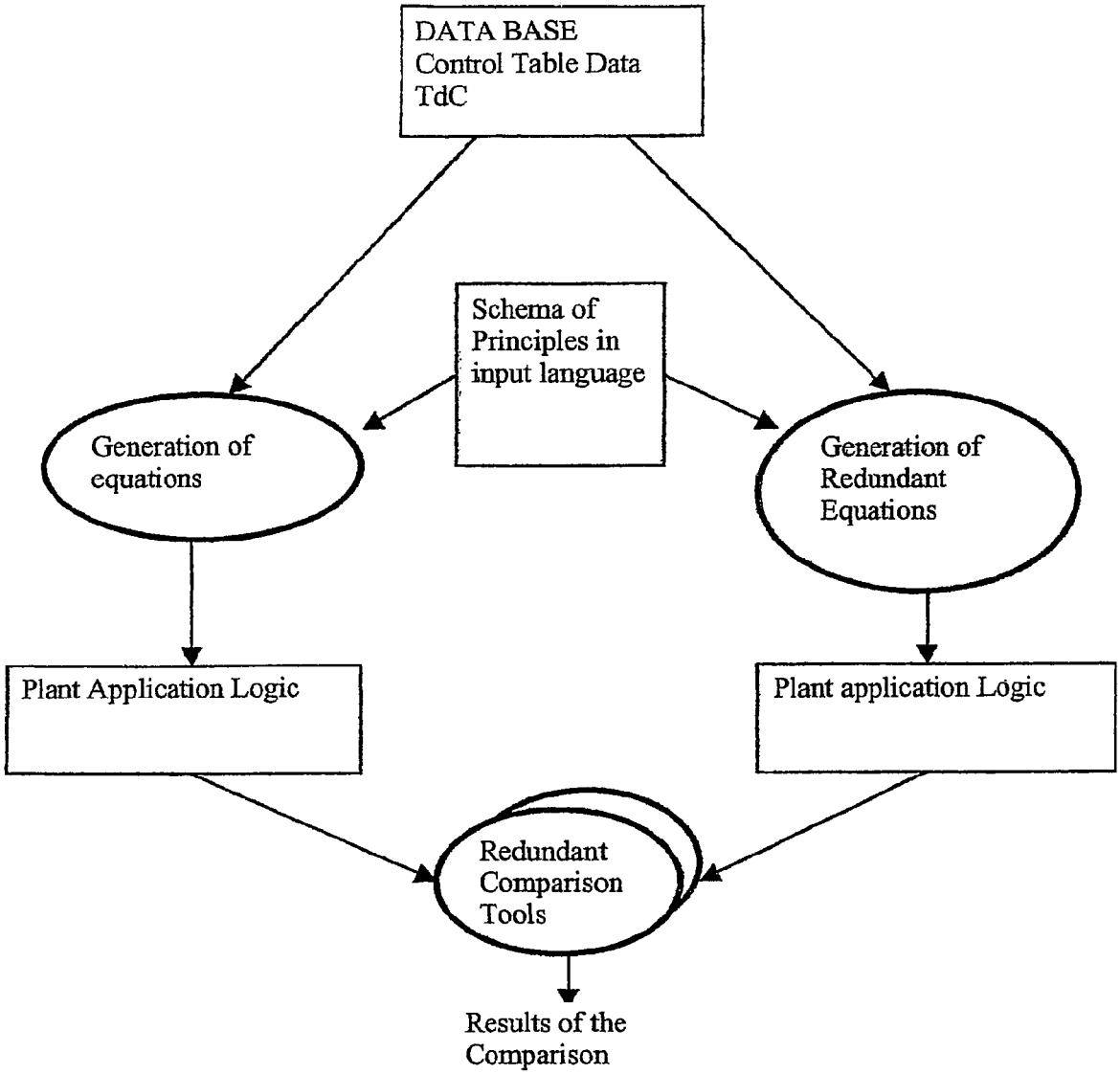
FIG. 1 is a flow chart of the inventive method.

Referring to FIG. 1, the method of the invention provides the automated and redundant generation of the station system controlling and monitoring logic, i.e. a central unit for controlling and supervising the different elements, such as lights, railroad switches, track circuits, or the like, located in a particular station. The central control and monitoring unit, which is named Station-based Vital Computer Stationary Apparatus generally includes two logic control and monitoring levels. The general procedure-oriented control, monitoring and possibly diagnostic logics consist of procedure-oriented programs which are independent from specific station systems and from the structure thereof, as well as from the number and types of elements and/or of the particular railroad traffic requirements. Typically, these programs use logic structures that transmit Boolean output data and receive Boolean input data, having true/false meanings.

These universal procedure-oriented programs cannot operate properly in all systems, and require processing of logic data, particularly controls and feedbacks, as well as diagnostic data, which are structured in compliance with the specific configurations of the railroad station system. Further, any specific station system must accomplish specific railroad traffic management operations, which are to be performed according to predetermined safe management rules. These rules require the concatenation of state assuming controls to and proper performance feedbacks from the different elements in accordance with predetermined diagrams which do not only depend on the specific system, but also on state control and switching standards, and on movement execution rules, which vary on a per-case basis and depending on railroad traffic management organizations.

With reference to the above and to FIG. 1, the invention relates to a method for automated generation of said station system-specific control and monitoring logics, which includes a first step for processing station system diagram data and element control management and/or state switching rules, in a discernible form, from a program for generating said control and monitoring and/or diagnostic logic. Therefore, two databases are generated, one for system configuration and the other for element state assuming and/or switching rules which accounts for relations or concatenations of controls with other elements that are possibly involved by the control of a first element.

The station system construction configuration database and the state table database (state assuming or state switching rules for the different elements) form the so-called knowledge base for an algorithm for generating the control and monitoring and/or diagnostic logic for the specific railroad system.

Then, the data are transmitted as a knowledge database to a program for analyzing and generating control and monitoring Boolean equations, which equations substantially constitute the algorithms that form the control and monitoring program. Parallel thereto, the same knowledge base data relating to the station system and to the state table is transmitted to a second analysis and processing program which generates a second set of Boolean equations, to form a second logic control and monitoring program relating to the same station and based on the same management rules as the first program.

Then, the two sets of Boolean equations are compared by comparison algorithms. The comparison result determines if the Boolean equations which form the core of the station-specific control and monitoring logic program have been generated correctly or if generation errors occurred.

When the two sets of Boolean equations are found to be identical, they are deemed to be correct, and the control and monitoring logic program is deemed to be safety-certified. When differences are detected, the comparison program transmits difference reporting messages, which may also include error message notes or specific indications on the detected differences and on the errors which may possibly or probably have caused the differences.

In the latter case, a correction action is needed, whereupon the generation process must be repeated.

The redundant generation and comparison step safely replaces prior art checking steps, which are carried out when the control and monitoring logic program is loaded in the central control unit and when functional field checks are carried out directory in the station system, thereby implying cost and duration drawbacks.

The checking step based on redundant generation and comparison of redundant sets of Boolean equations is performed either in the same computer as the generation computer or in a dedicated computer, and is relatively fast. Parallel generation may be performed temporarily in parallel either in the same computer or in separate computers.

The differences between the programs for generating sets of Boolean equations may be set at different levels. This may be obtained by using different programming languages or by having said generation programs developed by different teams of developers. For instance, when neural networks are used, a huge number of networks exist, provided by different developers, which analyze knowledge bases according to different rules, and generally providing identical results, although at slightly different times.

Obviously, redundant generation may not only be limited to one additional generation process and, when more than two generation programs are available, Boolean equations may be redundantly generated in two, three or more sets, whereby said equations, hence the station system-specific control and monitoring logic program can be checked with a higher safety level, with no considerable increase of costs or processing times.

According to an improvement, a preliminary step may be provided in which the input database containing the station system diagram and the state table is generated and a check is performed on the translation of the station diagram and the program-specific correction table into the input format, so as to filter out wrong equations produced by wrongly coded station system information and of state table into the knowledge base language for generation programs. In this case, the preliminary step for station-specific generation of the control and monitoring logic program includes the steps for checking the knowledge base, both as regards the structure thereof and as regards the consistency of the data coded in the knowledge base with the system diagram and with the state table.

In a particular example, the above steps are performed as follows:

The knowledge base is constructed by reading the definitions and the data contained in the various input files of a "Diagrams directory" and of a "Station directory". These definitions and data correspond to the station diagram expressed in a coded language and to the state table database respectively. After being read, the data and definitions are added to the knowledge base, which is used to properly perform the two successive operations.

The two generation programs require the following typical input diagram files

| |
|---|
| configurazione.pl |
| componenti.pl |
| subnet.pl |
| agenda.pl |

These files must be allocated in one directory, hereafter the "Diagrams directory" which may be accessed by the two generation programs. Moreover, this directory shall contain a file (ending in, a ".pl" extension) for each functional phase being referenced in the file 'agenda.pl'. These functional steps are those defined at the station system diagram level.

The two generation programs require the following input files, which relate to the database obtained from the state table of each station:

| |
|---|
| db_tabella.pl |
| db2_tabella.pl |

These files must be allocated in one directory, hereafter the "Station directory" which may be accessed by the generation programs. This directory may be obviously different from the above defined "Diagrams directory".

Upon processing, the generation programs generate the following report files, which are allocated in the 'Diagrams directory' and in the 'Station directory' respectively of their generation program.

| |
|---|
| ades2++_schemistica.log |
| ades2++_stazione.log |
| ades2_schemistica.log |
| ades2_stazione.log |

In this case, the two generation programs are named ades2 and ades2++ respectively.

Regarding the programs ades2++ or ades2 or both, the above files contain text messages which relate to the various execution steps of the application, including any error messages generated by an improper syntax of input files or by errors during the generation of station-specific Boolean equations.

Therefore, the following Boolean equations are generated, for each specific station, in the following file, which is contained in the 'Station directory'.

| |
|---|
| ades2++_equazioni.dat |
| ades2equazioni.dat |

The format wherewith the generation program ades2++ writes Boolean equations is also used by ades2. Equivalent text lines will be added at the start or at the end of the file, and appropriate commentary lines will be inserted to delimit the equations produced for each functional step. If equations are generated more than once, the last two generated Boolean equations are saved in the 'Station directory', after being suitably renamed as

| |
|---|
| ades2++_equazioni.bak |
| ades2_equazioni.bak |

Starting from knowledge base data (provided the latter is correctly generated), a station logic is generated for each functional step as defined in the file "agenda.pl". This logic is generated as all ordered set of logic circuits, each circuit being constructed by applying the relevant definitions of the principle diagram to station-specific data. Each circuit contains a network of components and a list of one or more terminal components.

The program for redundant generation of Boolean equations ades2++ converts the circuits generated during the previous step into Boolean equations. Each circuit is converted into one or more equations, the number of generated equations being also determined by certain configuration restrictions imposed by the central control unit, i.e. the so-called Station-based Vital Computer Apparatus.

Each equation is composed of a list of resulting Boolean variables and of an expression composed of operations on terms which include Boolean variables. Each of these variables represents in turn a (terminal or non-terminal) component of a circuit, or a 'virtual' component which is used to connect two equations constructed from the same circuit. The generation program writes each equation, in the appropriate order, in the file named 'ades2++_equazioni.dat', which is contained in the 'Station directory' associated to the selected station. In this file, equations are generated exactly in the same order as the one they have in the equivalent file, which is generated by the first generation program ades2.

A user interface example will be now described, specifically referring to the generation by the second generation program ades2++. Here a description will be provided of the step in which the knowledge base is loaded and the correctness and consistency check is performed, with further reference to the generation step involving the first generation program ades2 in the previous example.

When the application ADES2++ is launched in Windows, the following general information message will be displayed.

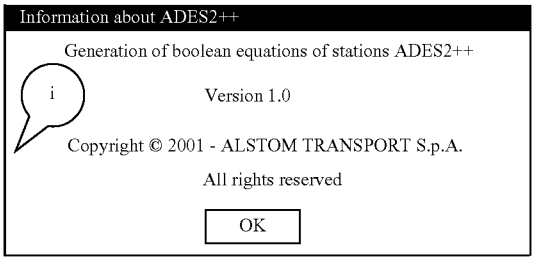

The computer screen will display an application window, containing all controls and buttons as shown in the underlying window. It shall be noted that the application release is mentioned in the window title. As usual, the window may be moved, minimized, maximized and closed, by using Windows typical buttons and features. It shall be further noted that the window shows the Diagrams directory and Station directory files which were used by the first program for generating the control and monitoring logic program, named ades2.

The window contains all controls that may be used to select the appropriate Diagrams and Station directories. Particularly, the window contains three buttons, each being used to select one of the previously described modes. Two additional buttons are also provided, which allow to consult diagram and station report files respectively. The status bar at the bottom of the window is used by the application to display certain status information. Buttons are always enabled, except when one of the main functions is running. This allows the user to use the application more than once, on the same dataset or on other datasets. The user may quit the application anytime, by closing the application window. In this case, the user will be asked to confirm exit, by using the following dialog.

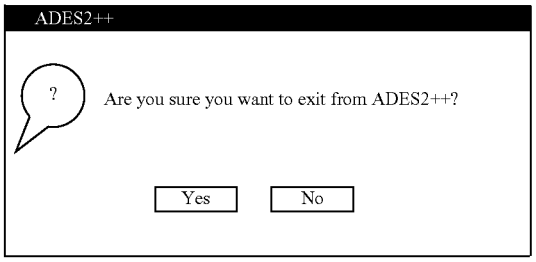

In order to use the above features, the user shall fill the appropriate controls with the full name of the directories containing the input files relating to the diagrams and to the relevant station.

By left clicking the button 'Carica Dati di Stazione', the user may generate the knowledge base from diagram data and specific station data. If a knowledge base for the relevant station and diagrams has already been generated, the following warning message will be displayed, to ask the user to expressly confirm the new creation.

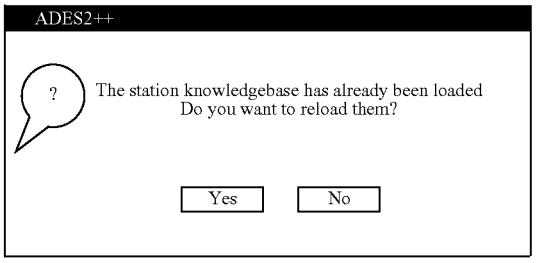

The knowledge base generation feature tries to sequentially read the indicated input files. If a file reading error occurs, a message like the one shown below is displayed and the knowledge base generation is terminated.

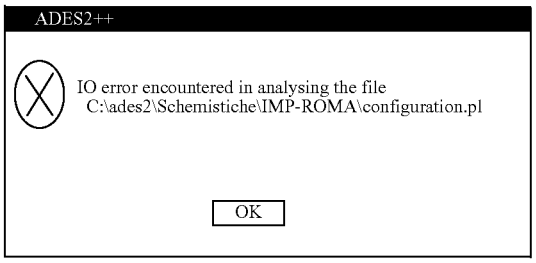

If one of the requested files is not found in the specified directories, a message like the one shown below is displayed and the knowledge base generation is terminated.

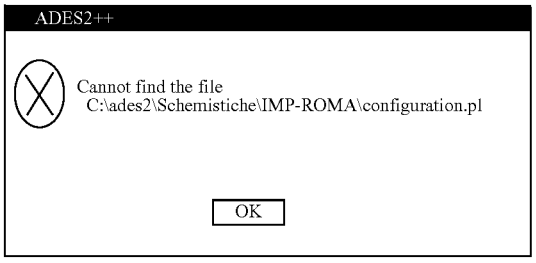

Moreover, if the specified files contain syntax errors, the knowledge base generation will terminate as soon as the first error is encountered, whereupon a message is displayed indicating the file name and line number whereat the error occurred (as shown below).

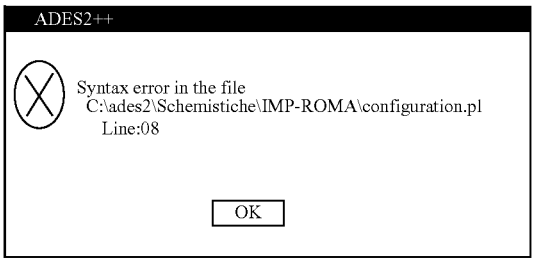

However, if the specified files contain no syntax errors, the knowledge base generation will continue until all input files have been read. Any other error detected in the definition of the principle diagram, expressed in input format, will be included in the report file generated in the 'Diagrams directory'. Each inconsistent definition in the principle diagram will not be inserted in the knowledge base. However, incomplete definitions of the principle diagram, such as design rules associated to non-existent components, will be loaded anyway.

When errors occur, a relevant message will be displayed at the end of the generation process, as shown below.

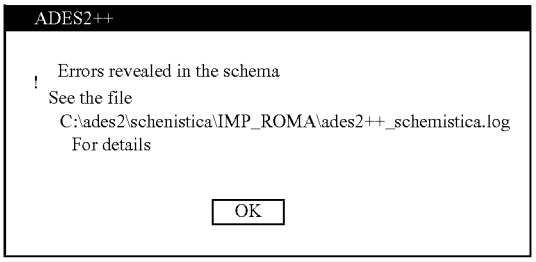

By left clicking the button 'Generate Station Logic', ADES2++ will execute the Station Logic generation function, from the previously generated knowledge base. (If the database is incomplete, the generated logic is also incomplete.)

If the diagram and station logic has already been generated, before generating it anew, the user will be asked for a confirmation, by the following message.

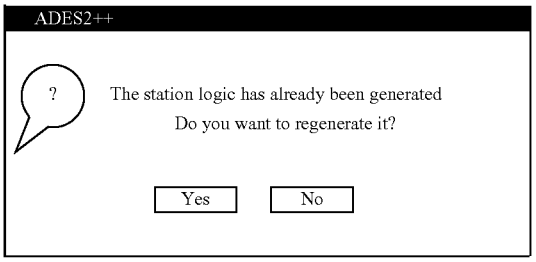

While logic generation is running, appropriate messages will appear in the status bar, to indicate the functional step wherefore the system is generating the logic, and the number of generated circuits (for that step), as well as the total number of circuits generated until that moment.

The total number of generated circuits (for all steps) will be displayed in the status bar when the process is completed. It shall be noted that the number of generated circuits may be smaller than the number of equations which will be generated thereafter during the storage step.

During the logic generation step, depending on currently loaded data, one single component may be allocated as a terminal component to more than one logic circuit. Each occurrence of such event will be identified as an error, and as such it will be indicated in the report file generated in the 'Station directory'. Even when the name of a component exceeds the maximum admitted length, a message will be displayed. If one or more errors have been detected at the end of the logic generation step, an appropriate warning message will appear on the screen, as shown below.

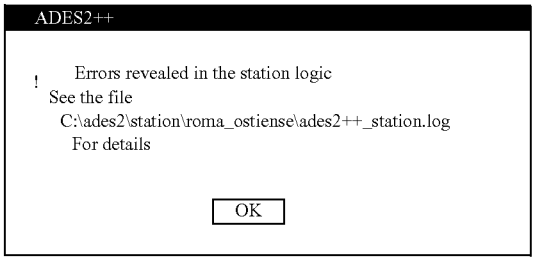

By left clicking the button 'store station equations', the generated logic circuits are converted into Boolean equations. (When no logic generation occurs an empty file, i.e. containing no equation, will be generated).

When an equation file has been previously generated for the same station, a backup copy thereof will be created before the new generation of equations starts.

It may happen that, while results are generated from a certain equation, the application tries to use a component which has been previously defined as 'state', but is not being used as a non-terminal component in any circuit. This event will be notified by the application. If no other terminal components are allocated to that circuit, no Boolean equation will be generated therefrom. In this case, the application will display a warning message at the end of the generation process, as shown below.

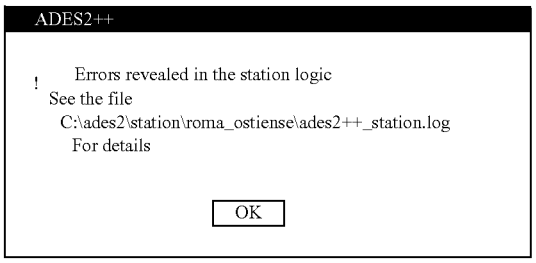

As usual, these events will be also reported in the report file created in the 'Station directory'.

By left clicking one of the two buttons 'Open Scheme report' or 'Open Station Report', the user may recall the generated report files relating to the principle diagram expressed in input format or to station data. In other words, by clicking on one of these two buttons, the user may open a text window which reports the current content of the two files.

The user may open more report windows for the same file.

With reference to the above example, differences may result between the two generation programs in the input data consistency check procedures and in error messages during logic generation.

An equation file generated by ades2++ for a certain diagram and a certain station is directly comparable with the equation file generated by ades2 from the same files. Therefore, commercial comparison tools may be used to compare the two files.

Particularly, the number and order of equations, and the results of each equation in one file must be identical to those of the other file. The equation expressions of one file shall be also equivalent to those of the other file, i.e. each term and operation contained in the expression of an equation in a file shall also appear in the expression of the associated equation in the other file. The order of terms in any product or sum expression of an expression in a file may be different from the one of the associated expression in the other file. This is due to the fact that the algorithms which are used to construct the expressions are intentionally different in the two applications and, even though they both have to meet the strict station logic generation requirements (i.e. they have to be complete and expressed in correct order), there will be cases in which different requirements will involve differences in the order of expressions. Anyway, these cases will be very rare in practice.

Regarding comparison programs, this method has the advantage that commercial programs may be used, such as: MKS Visual Difference for Win32—Rel. 3.2b Mortice Kern Systems Inc and/or Microsoft® WinDiff—Rel. 4.0 Microsoft Corp.

Figure 2:
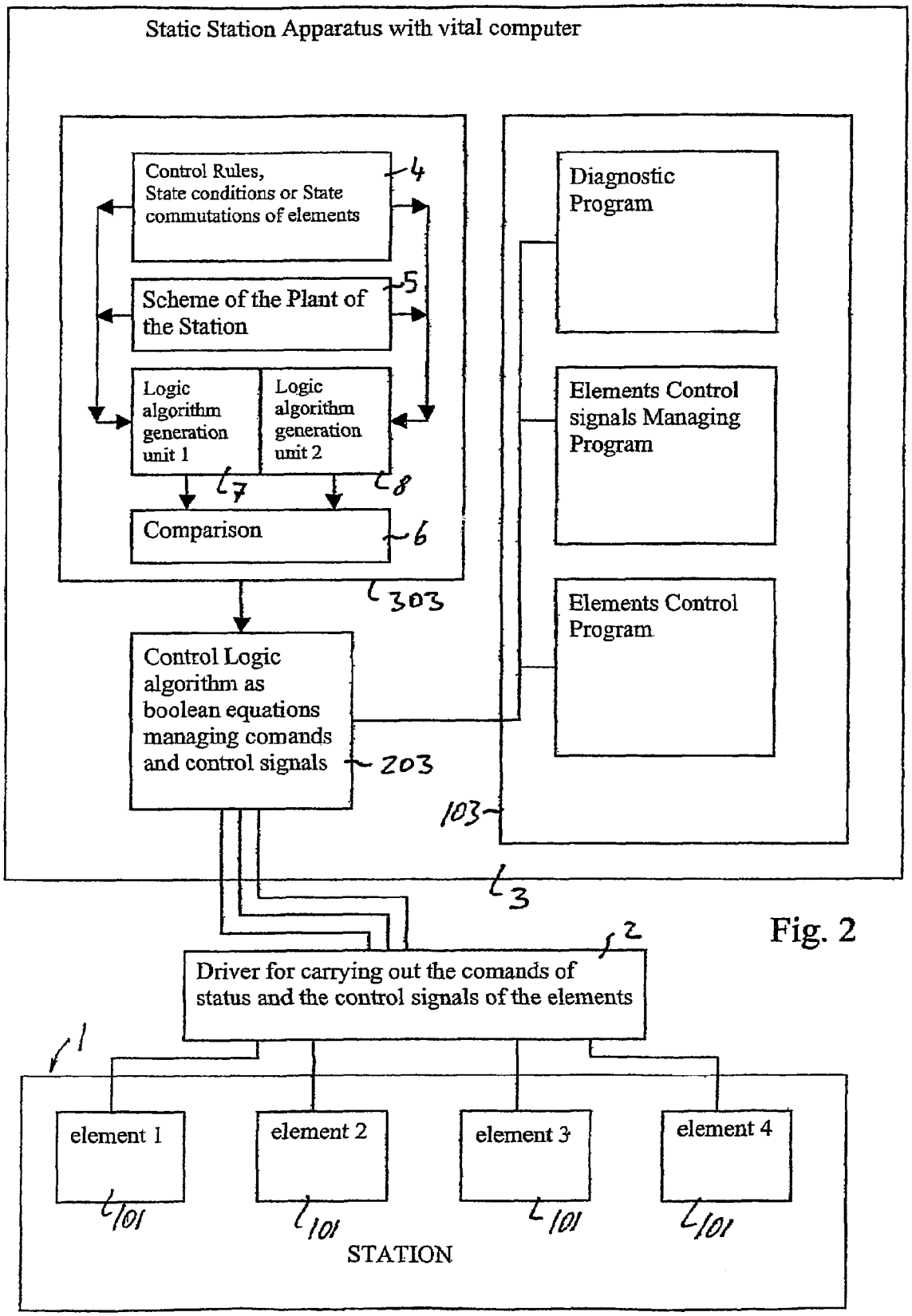
FIG. 2 is a block diagram of a station system, having a Vital Computer Apparatus according to this invention.

FIG. 2 shows a Vital Computer Stationary Apparatus, i.e. a central control and monitoring unit, according to the present invention, which also integrates the means for redundant generation of station system-specific control and monitoring logic programs.

Numeral 1 denotes a station having a plurality of different station elements 101 from 1 to N, such as signal lights, railroad switches, track circuits, and others.

Each element 101 is controlled by a driver which may consist of or include hardware or software, and is element-specific and always the same for each specific element. The drivers 2 have input interfaces for controls and output interfaces for feedback and diagnostic signals. These inputs and outputs are connected with appropriate inputs and outputs of a central control unit 3 which is named Vital Computer Stationary Apparatus.

This central unit 3 includes management programs, for controlling and monitoring the elements 101 as well as diagnostic programs, and also constitutes the interface between the personnel and the system.

From a functional point of view, the central unit may be divided into two main areas. One of them, indicated with numeral 103 in FIG. 2, is designed to execute diagnostic, element monitoring and element control procedures, and is composed of universally applicable procedure-oriented programs.

The other area, indicated with numeral 203 in FIG. 2, constitutes the real control and monitoring logic and consists of a control and monitoring logic program. This program may also possibly manage diagnostic functions, even though a special section is generally provided for diagnostics.

The two areas 103, 203, which are systematically separated, must coexist, otherwise the system cannot work. The general diagnostic, control and monitoring management programs shall be integrated or anyway interfaced with the control and monitoring logic. The latter is strictly dependent from and incorporates all peculiarities and specificities of the station system and of railroad traffic management rules that are applicable therein. Hence, the station logic shall be generated in such a manner as to be dedicated and specific to each station whereto the central unit 3 is associated. According to the invention, the Vital Computer Stationary Apparatus, i.e. the control and monitoring unit 3 includes means for automated generation of the control and monitoring logic program which are stably integrated, as section 303 in the system or software of said control unit 3.

Particularly, these means consist of means for inputting the station diagram 4 and the state switching rules 5 for the various elements for railroad traffic management in said station, and means for generating a knowledge base from said information, which is to be used by a program for generating said control and monitoring logic program. In the illustrated embodiment, said means consist of hardware means, i.e. a dedicated computer or by the computer which also controls the central control and monitoring unit 3, and of the software loaded therein.

Particularly, said software is designed in such a manner as to ensure a redundant generation 7, 8 of control and monitoring logic programs and as to subsequently execute a check in the generation section 303 and/or the central control and monitoring unit 3, on the generated logic programs, on the basis of an identity comparison 6 between the multiple, particularly two logic programs 7, 8 generated in parallel. Parallel generation is performed according to two different generation programs which retrieve data from the same knowledge base 4, 5 and provide the Boolean equations designed to form the core of the algorithms of control and monitoring logic programs. If the comparison results in the identity between the two sets of Boolean equations provided by the two different generation programs 7, 8, or having a certain difference degree, then said set of Boolean equations is deemed to be correct and is used to generate the control and monitoring logic program in its full form, which obviously requires sections of adaptation to the structural restrictions imposed by the construction of the central control and monitoring unit 3.

It shall be noted that the redundant generation of the control and monitoring logic 203 is not limited to two parallel generation procedures, and that three or more parallel generation procedures may be also provided.

By permanently adding the section 303 for generating the control and monitoring logic to the central control and monitoring unit 3, the central control and monitoring unit 3 may be easily modified and integrated, whenever changes are made to the railroad station system, e.g. elements are added or removed. Here, the section 303 for generating the control and monitoring logic would be only used to make a change to the previously used control and monitoring logic to account for system changes. Changes may be not only required by the addition or removal of elements to be controlled, but also by changes to element control and monitoring rules, which are summarized in the so-called state tables. In this case, the control and monitoring logic also needs to be changed.

The advantages of redundant generation and correctness check by comparison between the programs, i.e. the generated sets of Boolean equations, are particularly apparent when changes are made to the system. Here, while in prior art the modified logic should be typically field checked, thanks to the method of the invention, everything is processed by the computer of the central unit or by a computer-based secondary station. This drastically reduces system update times, as well as costs.

While the invention has been described with particular reference to software-based control logics, it shall be noted that it is also applicable when control logics are to be implemented in dedicated hardware. In this case, for example networks of logic components in the form or relays or semiconductor components would replace the control and monitoring logic software, circuit diagrams being directly and automatically generated by generation programs.

Also, the above description clearly shows that the step of generating a software control and monitoring logic directly derives from the step of generating virtual logic circuits, further translated by the generation program into a software form, whose core is formed by sets of Boolean equations.

Obviously, the invention is not limited to the above description and figures, but may be greatly varied without departure from the inventive, teaching disclosed above and claimed below.

The invention claimed is:

1. A method of generating logic control units for railroad station-based Vital Computer Apparatuses for railroad station system control units comprising at least one vital computer which, on the basis of a control program operating in combination with a logic unit, sends state switching controls to so-called yard elements devices that are designed to perform specific train circulation-related operations, and receives state feedback and/or diagnostic signals from said yard elements, said logic unit being generated automatically by a program, on the basis of the surrounding conditions as defined by a station diagram, comprising the list of yard elements, and by a state table, wherein state assuming and/or state switching rules are settled for said yard elements, with reference to state and/or to state switching of the other yard elements and/or to the proper management of railroad traffic, said logic unit being a network of circuits with components operating according to Boolean logic functions and appropriately structured in compliance with the station diagram and with the state table, or said logic control unit being a program which includes algorithms composed of Boolean logic functions, which operate like networks of Boolean logic circuits, wherein it includes a step for checking correctness of the automatically generated logic unit, which check step includes the following steps:

parallel generation of two logic control units, to the same station diagram and the same state table, each unit being generated by one of two generation programs which are as different as possible from each other;

comparison between the networks of logic circuits or the network-simulating logic programs provided the two different generation programs to check for structural differences therebetween.

2. A method as claimed in claim 1, wherein, when an identity is achieved, the correctness of the networks of logic circuits or of the generated logic program is deemed to be checked.

3. A method as claimed in claim 1, wherein, when the two logic programs are found to be non-identical, an error checking steps is performed, and the steps of parallel generation of the networks of logic circuits and/or network simulating virtual logic programs are repeated.

4. A method as claimed in claim 1, wherein the difference between the two generation programs relates to their languages or to the programming environments wherein they were written.

5. A method as claimed in claim 1, wherein the two different generation programs use different generation algorithms.

6. A method as claimed in claim 1, wherein the two different generation programs are two different neural networks.

7. A method as claimed in claim 1, wherein it includes a step for preparing a knowledge base containing station diagram related data and state table related data which are coded in such a manner as to be discernible by both generation programs.

8. A method as claimed in claim 7, wherein one or both generation programs include a pre-generation step, in which the knowledge base data is checked for consistency and correctness of both data structure and meaning.

9. A method as claimed in claim 1, wherein it includes a program for comparing the logic programs and/or the networks of logic circuits generated by the two generation programs, which comparison program is separated from the generation programs.

10. A method as claimed in claim 1, wherein the two generation programs generate the logic programs with the following procedure:

Generation of networks of logic circuits which use logic hardware components;

Conversion of the networks of logic circuits so generated into logic algorithms composed of sets of Boolean equations whose behavior correspondence to that of said networks of logic circuits.

11. A method as claim in claim 1, wherein it is used when logic circuits and/or logic programs are to be changed to be adapted to changes of the station system diagram and/or of the state table.

12. A method as claimed in claim 1, wherein the specific train circulation-related operations comprise signaling devices and/or railroad switches and/or track circuits.

13. A Vital Computer Stationary Apparatus including a computer wherein a program is loaded to control and monitor yard elements of a station system, which operate according to different rules, wherein the control program includes a section of general procedure-oriented programs, that are applicable both to a station system structure and to a state table, which program is interfaced and integrated with a control and monitoring logic program, which incorporates the station system structure and the state table, and is automatically generated and checked by a section of the Vital Computer Stationary Apparatus, that may be recalled at will, wherein the section for generating the control and monitoring logic program comprises at least two different generation programs, for generating comparable control and monitoring logic programs which are loaded, after a successful identity check, in the memory of the Vital Computer Stationary Apparatus and are interfaces with the section of general procedure-oriented programs.

14. A Vital Computer Stationary Apparatus as claimed in claim 13, wherein the section for generating the control and monitoring logic program constitutes a section for changing and/or updating said control and monitoring logic program.

* * * * *